US011401800B2

(12) United States Patent
Tippit et al.

(10) Patent No.: US 11,401,800 B2
(45) Date of Patent: Aug. 2, 2022

(54) METHOD FOR RESERVOIR MONITORING, METHOD OF PREPARING A RESERVOIR, AND RESERVOIR ADAPTED FOR MONITORING

(71) Applicant: JOHNSON MATTHEY PUBLIC LIMITED COMPANY, London (GB)

(72) Inventors: Justin Tippit, Pasadena, TX (US); Chun-tian Zhao, Billingham Cleveland (GB)

(73) Assignee: Johnson Matthey Public Limited Company, London (GB)

( * ) Notice: Subject to any disclaimer, the term of this patent is extended or adjusted under 35 U.S.C. 154(b) by 5 days.

(21) Appl. No.: 17/259,835

(22) PCT Filed: Jul. 22, 2019

(86) PCT No.: PCT/GB2019/052046

§ 371 (c)(1),
(2) Date: Jan. 12, 2021

(87) PCT Pub. No.: WO2020/025929

PCT Pub. Date: Feb. 6, 2020

(65) Prior Publication Data

US 2021/0301651 A1 Sep. 30, 2021

Related U.S. Application Data

(60) Provisional application No. 62/714,181, filed on Aug. 3, 2018.

(30) Foreign Application Priority Data

Aug. 28, 2018 (GB) ..... 1813981

(51) Int. Cl.
*E21B 47/11* (2012.01)
*E21B 43/14* (2006.01)

(52) U.S. Cl.
CPC ..... *E21B 47/11* (2020.05); *E21B 43/14* (2013.01)

(58) Field of Classification Search
None
See application file for complete search history.

(56) References Cited

U.S. PATENT DOCUMENTS 5,892,147 A 4/1999 Garnes et al.
2001/0036667 A1 11/2001 Tayebi et al.
(Continued)

FOREIGN PATENT DOCUMENTS

WO 2014/168483 A2 10/2014
WO 2016/174413 A1 11/2016
WO 2017/176121 A1 10/2017

*Primary Examiner* — Charles R Nold
(74) *Attorney, Agent, or Firm* — BakerHostetler

(57) ABSTRACT

A method for monitoring the production from different zones/sections along a well bore in a subsurface reservoir to draw inferences regarding production gases emerging from the subsurface reservoir, comprising: dividing the reservoir into a plurality of different zones/sections along the well bore; in a completion stage, deploying along the well bore in each such zone/section a release system for the release of at least one oil and/or water tracer material, such that a unique tracer formulation is provided in association with each respective such zone section; in a production stage, producing fluid from the reservoir, separating, sampling and testing liquids from the produced fluid and detecting the tracer materials in the produced liquids, drawing inferences from the detected levels of the tracer materials in the produced liquids regarding the production gases emerging from the subsurface reservoir.

5 Claims, 1 Drawing Sheet

(56) References Cited

U.S. PATENT DOCUMENTS

| | | | | |
|---|---|---|---|---|
| 2013/0245948 | A1 | 9/2013 | Nyhavn | |
| 2016/0047231 | A1* | 2/2016 | Nyhavn | E21B 43/16 166/254.1 |
| 2017/0370210 | A1 | 12/2017 | Nyhavn et al. | |

* cited by examiner

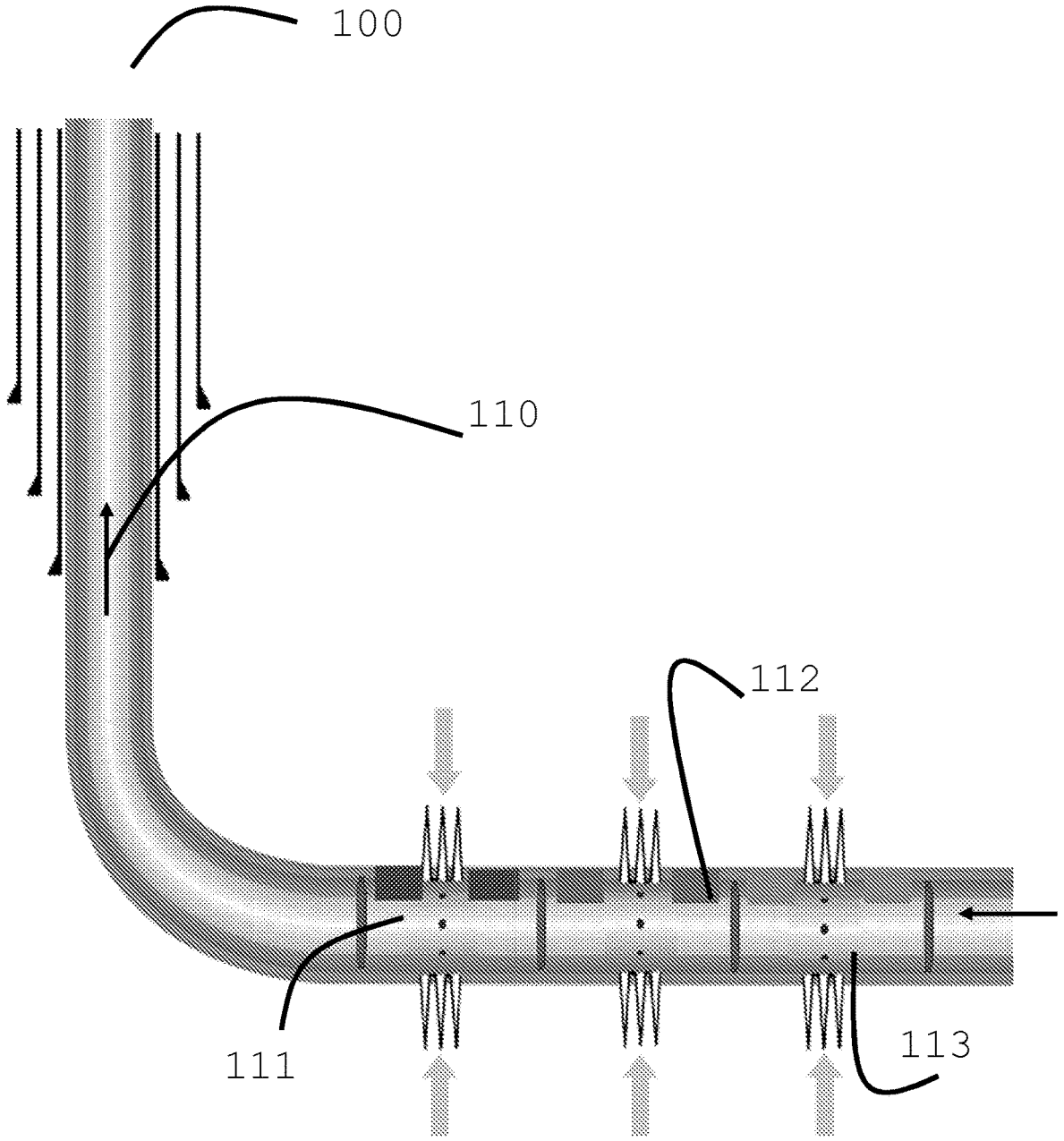
100
110
112
111
113

METHOD FOR RESERVOIR MONITORING, METHOD OF PREPARING A RESERVOIR, AND RESERVOIR ADAPTED FOR MONITORING

FIELD OF INVENTION

The present invention concerns a method for monitoring production fluids emerging from a subsurface reservoir in particular by releasing tracer materials into a subsurface reservoir. The invention also concerns a method of preparing a subsurface reservoir for the monitoring of production fluids emerging from a subsurface reservoir and a subsurface reservoir adapted to enable such monitoring. The invention in particular relates using tracer materials and principles to draw useful inferences regarding production gases emerging from a subsurface reservoir.

BACKGROUND

Oilfield production fluids (e.g., oil, gas, and water) are complex mixtures of aliphatic hydrocarbons, aromatics, hetero-atomic molecules, anionic and cationic salts, acids, sands, silts, clays and a vast array of other components in various amounts. Optimal oil and gas production from the reservoir depends upon reliable knowledge of the production characteristics of the reservoir.

In oilfield applications, it is well known to release reagents for monitoring the production of reservoir fluids from areas (zones) of the hydrocarbon reservoirs. These reagents are more commonly known as tracers. They can be broadly categorized into two distinct types; radioactive and chemical (non-radioactive) tracers. Tracers have been used extensively in the areas of oil and gas production and hydrology for decades. Non-radioactive chemical tracers offer distinct advantages over the use of radioactive tracers. For example, there are more unique chemical tracers than radioactive tracers.

The use of tracers to obtain information about a hydrocarbon reservoir and/or about what is taking place therein has been practiced for several decades and has been described in numerous documents. Tracers have in particular been used to monitor fluid paths and velocities in liquid hydrocarbon/water mixtures. More than one tracer substance can be used concurrently. For instance, U.S. Pat. No. 5,892,147 discloses a procedure in which different tracers are placed at respective locations along the length of a well penetrating a reservoir. The tracers are placed at these locations during completion of the well before production begins. The tracer at each location is chemically immobilized at the location. When production begins, monitoring the presence and/or proportions of the individual tracers downstream permits information to be derived about the liquid hydrocarbon and water production from different production zones of the reservoir.

In one classification, non-radioactive chemical tracers are grouped as water tracers, oil tracers and gas tracers, etc., depending on the phases they are targeted to stay in. Oil tracers and waters tracers are used to trace the inflow of oil and water respectively. Oil tracers are soluble in oil while water tracers are soluble in water.

It may be desirable to monitor production fluids including large proportions of gaseous product. Gas tracers are currently used but have historically found application primarily for interwell purposes, i.e., to study the connectivity of the wells and reservoir, rather than for the direct monitoring of the production of gas. Gas tracers are gaseous but may be liquids or solids which transform into, or emit, a gaseous species for gas tracing.

Examples of documents which disclose oil, water, and gas tracers include WO2017/176121, US2017/0370210, US2013/0245948, and US2001/0036667. These documents disclose zonal monitoring using tracers where gas tracers are used to trace production gas, water tracers are used to trace production water, and oil tracers are used to trace production oil.

It would be desirable to develop methods to monitor the production of gas from a hydrocarbon reservoir by using chemical tracers that associate into and are carried directly with the gas phase, but the development of reliable and commercially useful direct gas tracers for the direct monitoring of the production of the gas phase has proved difficult. For example, one particular reason why the inflow production of gas is not monitored by so-called gas tracers is that the gas tracers may be difficult to immobilise to targeted positions. Even where a liquid or solid tracer is immobilized to a targeted position and configured to transform into, or emit, a gaseous species for direct gas tracing, such transformations/emissions can be difficult to control.

Aspects of the present invention seek to ameliorate some or all of the above problems and to provide an improved method for monitoring fluids emerging from a subsurface reservoir. Particularly, but not exclusively, aspects of the invention seek to provide an improved method for drawing useful inferences regarding gases emerging from a subsurface reservoir.

SUMMARY OF THE INVENTION

According to a first aspect of the invention there is provided a method for monitoring the production from different zones/sections along a well bore in a subsurface reservoir to draw inferences regarding production gases emerging from the subsurface reservoir, the method comprising:

dividing the reservoir into a plurality of different zones/sections along the well bore;

in a completion stage, deploying along the well bore in each such zone/section at least one release system for the release of at least one non-radioactive oil and/or water chemical tracer material, such that at least one unique tracer formulation is provided in association with each respective such zone/section;

in a production stage, producing fluid from the reservoir resulting from co-producing condensed hydrocarbon, free flowing water or condensed water vapor, separating, sampling and testing liquids from the produced fluid and detecting the tracer materials in the produced liquids, drawing inferences from the detected levels of the tracer materials in the produced liquids regarding the production gases emerging from the subsurface reservoir.

The reservoir is a gas reservoir. That is to say, the reservoir production fluid is one in which gaseous products are produced, for example from each of the said zones/sections, and in particular one in which gaseous products predominate. The purpose of the method is to infer useful information regarding those production gases emerging from the reservoir. The method uses tracing principles. However, the method does not trace the production gases directly. It does not use tracers directly within the gas phase. Rather the invention uses oil and/or water tracers and the detection of these tracer materials in produced liquids carried in the predominantly gaseous production fluid, to draw indirect inferences about gas production. That is to say, rather than using gas tracers directly, oil and/or water tracing is used to draw indirect inferences about gas production. This differs from WO2017/176121, US2017/0370210, US2013/0245948, and US2001/0036667 which use gas tracers to trace production gas, water tracers to trace production water, and oil tracers to trace production oil.

The invention is characterised by the use of tracer formulations in each zone/section based on at least one oil tracer material or at least one water tracer material or mixtures of at least one oil tracer material and at least one water tracer material, and the detection of these tracer materials in produced liquids carried in the predominantly gaseous production fluid, to draw indirect inferences about gas production.

Each unique tracer formulation is preferably unique in the sense of being a uniquely physically formulated tracer formulation. Each unique tracer formulation may include one or more chemical tracers and one or more other materials. Each formulation may include either inorganic or organic materials or both. Organic materials may include polymeric materials. Each formulation may include mixtures of multiple materials. The tracer materials may be mixed with other materials for example carrier materials. The tracer materials in such a case are preferably not chemically bonded to the carrier materials.

The invention relies upon the realisation that since many gas reservoirs, while producing output that includes a predominant gas phase, contain liquids, and that these liquids may be mobilised or form due to changes in pressure and temperature within a reservoir during production and carried within the predominantly gaseous production fluid, and thereby monitoring of those liquids allows qualitative inferences to be drawn about the production of gases.

The invention is characterised by the use of tracer formulations in each zone/section based on at least one oil tracer material or at least one water tracer material or mixtures of at least one oil tracer material and at least one water tracer material, and the detection of these tracer materials in produced liquids carried in the predominantly gaseous production fluid, to draw indirect qualitative inferences about gas production from the respective zones.

It relies on the realisation that so long as the zone of the reservoir is producing gas product, the gas acts to mobilize the liquid phase. Thus, by direct tagging of the liquid phase it is possible to gain an insight into the gas production from different zones. So long as the characteristic oil or water tracers that have been deployed to tag the different zones are present and detected from a zone it indicates that gas is being produced from that zone and is mobilizing the liquid phase, which carries the tracer. This makes it an indirect qualitative measurement of gas production.

The problems encountered with direct use of gas tracers are avoided. Instead, the much more established technology of oil and water tracers may be made use of to draw effective inferences regarding gas production. The invention provides a way to monitor the gas production using established chemical oil and water tracers. It is a new way of using known inflow chemical tracers to generate information about gas production. The tracer release systems may be provided to suit the use in such conditions but using generally established and well-engineered principles. The invention allows the gas production from a hydrocarbon reservoir to be qualitatively monitored to allow the oil and gas field operators to have better knowledge of production of gas as well as oil and water, and provide assistance in making decisions of operations.

In accordance with the invention, tracers are introduced in that, in a completion stage, there is deployed along the well bore in each defined zone/section a release system for the release of at least one oil and/or water tracer material, such that a unique tracer formulation is provided in association with each respective such zone/section.

That is to say, the tracer(s) for respective zones/sections are provided from respective release system deployed in the completion stage, the release systems being systems that are constituted to retain the said tracer materials and release the same progressively over time into liquids carried in the production fluid during the production stage of operation.

The release system thus comprises a system by means of which one or more tracers are deployed at a desired location in each zone in accordance with the principles of the first aspect of the invention to be released progressively over time into liquids carried in the production fluid during the production stage of operation.

In a possible embodiment, the release system comprises one or more tracers immobilized at a desired location along the well bore, and the step of deploying along the well bore in each such zone/section a release system for the release of at least one oil and/or water tracer material comprises immobilizing one or more tracers at a desired location along the well bore in each such zone/section.

For example, the tracer(s) may be included in a release formulation such as to be eluted from the formulation over time as fluid flows past or through the formulation. In such an example, the step of deploying along the well bore in each such zone/section a release system for the release of at least one oil and/or water tracer material comprises including one or more tracers in each of a plurality of release formulations and locating at least one such release formulation at a desired location along the well bore in each such zone/section.

It follows that in a second aspect of the invention there is provided:

a method of preparing a subsurface reservoir for the monitoring of production of fluids from different zones/sections along a well bore in the subsurface reservoir to draw inferences regarding production gases emerging from the subsurface reservoir, the method comprising:

dividing the reservoir into a plurality of different zones/sections along the well bore;

in a completion stage, deploying along the well bore in each such zone/section a release system for the release of at least one non-radioactive oil and/or water chemical tracer material, such that a unique tracer formulation is provided in association with each respective such zone/section.

It further follows that in a third aspect of the invention there is provided:

a subsurface reservoir adapted to enable the monitoring of production of fluids from different zones/sections along a well bore in the subsurface reservoir to draw inferences regarding production gases emerging from the subsurface reservoir, wherein the reservoir is divided into a plurality of different zones/sections along the well bore;

there is deployed along the well bore in each such zone/section at least one release system for the release of at least one oil and/or water tracer material, such that at least one unique tracer formulation is provided in association with each respective such zone/section.

The performance in a production stage of the steps of producing fluid from the reservoir, separating, sampling and testing liquids from the produced fluid and detecting the tracer materials in the produced liquids, drawing inferences from the detected levels of the tracer materials in the produced liquids regarding the production gases emerging from the subsurface reservoir as supplementary steps to the method of the second aspect of the invention or on a well of the third aspect of the invention will thus constitute performance of the method of the first aspect of the invention, and preferred features of each aspect will be understood to be interchangeable by analogy.

The invention is applied to a reservoir that produces a fluid in which gaseous product predominates but in which some oil and/or water is mobilized during production. A method based on the deployment of such release systems into the well bore during the well completion stage is better suited to such a reservoir than a method based on injection.

Such release formations for oil and water tracers are well known in the art, and it is an advantage of the invention that as oil and water tracers are employed to obtain qualitative measurement of gas production, this well-established technology can be applied to the particular problems of monitoring the production of gas from a hydrocarbon reservoir.

Each tracer is thus deployed at a desired location along the well bore during construction of the well. For example, the tracer may be provided comprised in a solid article incorporated into or attached to a component part of the well. The tracer may be introduced into the well or formation as a liquid, as a solid, or as a solid or liquid encapsulated in another solid.

In a possible embodiment, one or more tracers may be mixed with a polymer and cast into a release formation that is inserted into the well when the well is constructed. The tracer is then eluted from the polymer over time as fluid flows past the article.

In a possible embodiment, one or more tracers may be microencapsulated in a microencapsulant to control rates of release. Optionally the microcapsules have an outer surface, and the tracer is contained within the microcapsules. For example, each microcapsule comprises: a core shell structure comprising: (a) a core comprising at least one oil field chemical and (b) a shell comprising a polymeric microencapsulant.

In a possible embodiment, one or more tracers may be incorporated into a release formation comprising: (a) microcapsules comprising a tracer and a microencapsulant, wherein the tracer is contained within the microcapsules, and (b) a bulk polymer, where the microcapsules are embedded within the bulk polymer.

Example of release formations for water and oil tracers are described in WO2016/174413.

BRIEF DESCRIPTION OF THE DRAWINGS

Embodiments of the present invention will now be described, by way of example, and not in any limitative sense, with reference to the accompanying drawings, of which:

FIG. 1 is simple schematic of a subsurface reservoir in which different tracers are placed at respective locations along the length of a well penetrating the reservoir to monitor gas production in accordance with the principles of the invention.

DETAILED DESCRIPTION

FIG. 1 is simple schematic of illustration of a subsurface reservoir wellbore 100 extending through one or more subterranean formations.

The potentially hydrocarbon-bearing part of the subterranean formation is in accordance with the principles of the invention divided into zones with three being shown in the example, respectively with distance from the surface 111, 112, 113.

Different tracers are placed at respective locations along the length of a well penetrating the reservoir in each of the said zones 111, 112, 113 and a production fluid resulting from co-producing condensed hydrocarbon, free flowing water or condensed water vapor is produced and taken from the wellbore in flow direction 110.

At a surface facility (not shown) liquids from the produced fluid are separated, sampled and tested. Although the testing is of liquids and of liquid tracers, and may rely upon established principles for such tracers, it is possible to draw inferences from the detected levels of the tracer materials in the produced liquids regarding the gas product emerging from each zone under test. This is because so long as the zone under test is producing gas product, the gas acts to mobilize the liquid phase. Thus, by direct tagging of the liquid phase it is possible to gain an insight into the gas production from different zones.

The invention thus provides a way to monitor the gas production using established chemical oil and water tracers. The invention allows the gas production from a hydrocarbon reservoir to be qualitatively monitored to allow the oil and gas field operators to have better knowledge of production of gas as well as oil and water, and provide assistance in making decisions of operations.

EXAMPLES

The invention provides a way to monitor the gas production using established chemical oil and water tracers. Suitable tracers might include the following.

Oil Soluble Tracers

Tracers used to track the movement of oil soluble materials generally have low water solubility and high (>1000) organic/water partition coefficients. Several families of such compounds have been used. Illustrative examples of suitable tracer compounds of the present invention are organic compounds selected from the hydrocarbons and halogenated hydrocarbons. Mixtures of these compounds can also be used although single compounds are preferred. The tracer compound can preferably be a halogenated aromatic, polycyclic aromatic, heterocyclic aromatic, aromatic ketone, cycloalkane, or aliphatic compound, where the compound including at least one halogen selected from the group consisting of Br, Cl, F and I. Suitable tracers include, but are not limited to 4-iodotoluene, 1,4-dibromobenzene, 1-chloro-4-iodobenzene, 5-iodo-m-xylene, 4-iodo-o-xylene, 3,5-dibromotoluene, 1,4-diiodobenzene, 1,2-diiodobenzene, 2,4-dibromomesitylene, 2,4,6-tribromotoluene, 1-iodonaphthalene, 2-iodobiphenyl, 9-bromophenanthrene, 2-bromonaphthalene, bromocyclohexane, 1,2-dichlorobenzene, 1,3-dichlorobenzene, 1,4-dichlorobenzene, 1-bromododecane, bromooctane, 1-bromo-4-chlorobenzene, bromobenzene, 1,2,3-trichlorobenzene, 4-chlorobenzylchloride, 1-bromo-4-fluorobenzene, perfluoromethylcyclopentane (PMCP), perfluoromethylcyclohexane (PMCH), perfluorodimethylcyclobutane (PDMCB), m-perfluorodimethylcyclohexane (m-PDMCH), o-perfluorodimethylcyclohexane (o-PDMCH), p-Perfluorodimethylcyclohexane (p-PDMCH), perfluorotrimethylcyclohexane (PTMCH), perfluoroethylcyclohexane (PECH), and perfluoroisopropylcyclohexane (IPPCH).

Oil soluble tracers can also be oil dispersible nanoparticles which may be detected by analytical techniques such as light absorption and emission (e.g., Raman, UV, IR and fluorescence) or electrochemical methods.

Water Soluble Tracers

Water soluble tracers can be used to trace the movement of production fluids containing water. Groups of compounds that are commonly described in the art as dyes, pigments, and colorants can be used. These compounds are often visible to the eye in either ambient or ultraviolet light. Suitable tracers useful with the present invention include but are not limited to those selected from the group consisting of: Acridine Orange; 2-anthracenesulfonic acid, sodium salt; Anthrasol Green IBA (Solubilized Vat Dye); bathophenanthrolinedisulfonic acid disodium salt; amino 2,5-benzene disulfonic acid; 2-(4-aminophenyl)-6-methylbenzothiazole; Brilliant Acid Yellow 8G (Lissamine Yellow FF, Acid Yellow 7); Celestine Blue; cresyl violet acetate; dibenzofuransulfonic acid, 1-isomer; dibenzofuransulfonic acid, 2-isomer; 1-ethylquinaldinium iodide; fluorescein; fluorescein, sodium salt (Acid Yellow 73, Uranine); Keyfluor White ST (Flu. Bright. 28); Keyfluor White CN; Leucophor BSB (Leucophor AP, Flu. Bright. 230); Leucophor BMB (Leucophor U, Flu. Bright. 290); Lucigenin (bis-N-methylacridinium nitrate); mono-, di-, or tri-sulfonated naphthalenes, including but not limited to—1,5-naphthalenedisulfonic acid, disodium salt (hydrate) (1,5-NDSA hydrate); 2-amino-1-naphthalenesulfonic acid; 5-amino-2-naphthalenesulfonic acid; 4-amino-3-hydroxy-1-naphthalenesulfonic acid; 6-amino-4-hydroxy-2-naphthalenesulfonic acid; 7-amino-1,3-naphthalenedisulfonic acid, potassium salt; 4-amino-5-hydroxy-2,7-naphthalenedisulfonic acid; 5-dimethylamino-1-naphthalenesulfonic acid; 1-amino-4-naphthalene sulfonic acid; 1-amino-7-naphthalene sulfonic acid; and 2,6-naphthalenedicarboxylic acid, dipotassium salt; 3,4,9,10-perylenetetracarboxylic acid; Phorwite CL (Flu. Bright. 191); Phorwite BKL (Flu. Bright. 200); Phorwite BHC 766; Pylaklor White S-15A; 1,3,6,8-pyrenetetrasulfonic acid, tetrasodium salt; pyranine, (8-hydroxy-1,3,6-pyrenetrisulfonic acid, trisodium salt); quinoline; Rhodalux; Rhodamine WT; Safranine 0; Sandoz CW (Flu. Bright, 235); Sandoz CD (Flu. Bright. 220); Sandoz TH-40; Sulforhodamine B (Acid Red 52); Tinopal 5BM-GX; Tinopol DCS; Tinopal CBS-X; Tinopal RBS 200; Titan Yellow (Thiazole Yellow G), and any existing ammonium, potassium and sodium salts thereof. Preferred fluorescent tracers are 1,3,6,8-pyrenetetrasulfonic acid, tetrasodium salt and 1,5-naphthalenedisulfonic acid, disodium salt (hydrate).

Water soluble tracers can also be water dispersible nanoparticles, which may be detected by analytical techniques such as light absorption and emission (e.g., Raman, UV, IR and fluorescence) and electrochemical methods.

Preferably the chemical tracers useful with the present invention include, but are not limited to: halogenated benzoic acids, salts and compounds derived from the acid such that they hydrolyze to form the acids, or salts thereof, in the reservoir, including 2-fluorobenzoic acid; 3-fluorobenzoic acid; 4-fluorobenzoic acid; 3,5-difluorobenzoic acid; 3,4-difluorobenzoic acid; 2,6-difluorobenzoic acid; 2,5-difluorobenzoic acid; 2,3-difluorobenzoic acid; 2,4-difluorobenzoic acid; pentafluorobenzoic acid; 2,3,4,5-tetrafluorobenzoic acid; 4-(trifluoro-methyl)benzoic acid; 2-(trifluoromethyl)benzoic acid; 3-(trifluoro-methyl)benzoic acid; 3,4,5-trifluorobenzoic acid; 2,4,5-trifluorobenzoic acid; 2,3,4-trifluorobenzoic acid; 2,3,5-trifluorobenzoic acid; 2,3,6-trifluorobenzoic acid; 2,4,6-trifluorobenzoic acid and the brominated, chlorinated and iodinated analogs thereof. When more than one halogen atom is present on the benzoic acid, the halogens can be the same or different. Preferably, the salts of the halogenated benzoic acids are sodium salts or potassium salts or mixed halogenated benzoates.

One or more such tracers may be deployed at each location as above described immobilized in a release formation for example being mixed with a polymer and cast into a release formation that is inserted into the well when the well is constructed. The tracer is then eluted from the polymer over time as fluid flows past the article.

The invention claimed is:

1. A method for monitoring the production of tracers from different zones/sections along a well bore in a subsurface reservoir to monitor production gases emerging from the different zones/sections the subsurface reservoir, comprising:

dividing the reservoir into a plurality of different zones/sections along the well bore;

in a completion stage, deploying along the well bore in each such zone/section at least one release system for the release of at least one non-radioactive oil and/or water chemical tracer material, such that at least one unique tracer formulation is provided in association with each respective such zone/section;

in a production stage, producing fluid from the reservoir, separating, sampling and testing liquids from the produced fluid and detecting the tracer materials in the produced liquids to monitor gas production from each zone/section based on the detected levels of the tracer materials in the produced liquids emerging from the subsurface reservoir, wherein the reservoir production fluid from each respective zone/section comprises gaseous products and liquids and the detection of the tracer material in the produced liquids carried in the gaseous products is used to monitor gas production from each zone/section.

2. A method according to claim 1 wherein the reservoir production fluid is one in which gaseous products predominate.

3. A method according to claim 1 wherein there is deployed along the well bore in each defined zone/section a release system by means of which one or more tracers are deployed at a desired location in each zone to be released progressively over time into liquids carried in the production fluid during the production stage of operation.

4. A method according to claim 1 wherein the release system comprises one or more tracers immobilized at a desired location along the well bore, and the step of deploying a release system along the well bore in each zone/section comprises immobilizing one or more tracers at a desired location along the well bore in each such zone/section.

5. A method according to claim 1 wherein the release system comprises one or more tracers contained in a release formation such as to be eluted from the formation over time as fluid flows past or through the formation and the step of deploying a release system along the well bore in each zone/section comprises including one or more tracers in each of a plurality of release formations and locating at least one such release formation at a desired location along the well bore in each such zone/section.

* * * * *